US010760263B2

(12) United States Patent
Hossler et al.

(10) Patent No.: US 10,760,263 B2
(45) Date of Patent: Sep. 1, 2020

(54) ROTATABLE CONNECTOR FOR TRUSSES

(71) Applicant: TIFFIN SCENIC STUDIOS, INC., Tiffin, OH (US)

(72) Inventors: Brad E. Hossler, Tiffin, OH (US); Scott T. Almand, Tiffin, OH (US)

(73) Assignee: TIFFIN SCENIC STUDIOS, INC., Tiffin, OH (US)

( * ) Notice: Subject to any disclaimer, the term of this patent is extended or adjusted under 35 U.S.C. 154(b) by 0 days.

(21) Appl. No.: 16/119,282

(22) Filed: Aug. 31, 2018

(65) Prior Publication Data

US 2019/0071861 A1 Mar. 7, 2019

Related U.S. Application Data

(60) Provisional application No. 62/554,346, filed on Sep. 5, 2017.

(51) Int. Cl.

| | |
|---|---|
| ***E04C 3/08*** | (2006.01) |
| ***E04B 1/41*** | (2006.01) |
| ***E04C 3/02*** | (2006.01) |
| ***E04B 1/58*** | (2006.01) |
| *E04C 3/04* | (2006.01) |

(52) U.S. Cl.

CPC ..... *E04B 1/40* (2013.01); *E04B 1/5843* (2013.01); *E04C 3/02* (2013.01); *E04B 2001/5856* (2013.01); *E04C 2003/0495* (2013.01)

(58) Field of Classification Search

CPC ..... E04C 3/08; E04C 2003/0495; E04C 2003/0491; E04B 1/585; E04B 1/1903; E04B 1/2403; E04H 3/24; E04H 12/187; Y10T 403/32213; F16G 15/08; F16B 21/165; F16B 7/0446

See application file for complete search history.

(56) References Cited

U.S. PATENT DOCUMENTS

| | | | | |
|---|---|---|---|---|
| 879,644 | A * | 2/1908 | Jeffries | |
| 933,625 | A * | 8/1909 | Clarkson | |
| 1,786,081 | A * | 12/1930 | Nourse | F16G 15/08 403/165 |
| 2,744,590 | A | 5/1956 | Butts | |
| 3,062,340 | A | 11/1962 | Mauritz | |
| 3,521,421 | A | 7/1970 | Schroeder, Jr. | |
| 3,727,362 | A | 4/1973 | Ellison et al. | |
| 3,744,206 | A | 7/1973 | Nickel et al. | |
| 3,850,533 | A | 11/1974 | Thielen | |
| 4,334,816 | A | 6/1982 | Slysh | |
| 4,646,552 | A | 3/1987 | Kanbe | |
| 4,655,021 | A | 4/1987 | Franchin et al. | |

(Continued)

FOREIGN PATENT DOCUMENTS

| | | |
|---|---|---|
| DE | 3344555 | 6/1985 |
| JP | 3968223 | 8/2007 |
| WO | WO 2014/139392 | 9/2014 |

*Primary Examiner* — Brian D Mattei
*Assistant Examiner* — Daniel J Kenny
(74) *Attorney, Agent, or Firm* — Barnes & Thornburg LLP; Alice O. Martin

(57) ABSTRACT

A rotatable connector for use with a truss in accordance with the present disclosure includes a sleeve and a connector end coupled to the sleeve. The sleeve engages with the truss in a fixed orientation. The connector end rotates relative to the truss to allow attachment with another connector of an adjacent truss in a variety of orientations.

20 Claims, 5 Drawing Sheets

(56) References Cited

U.S. PATENT DOCUMENTS 4,765,114 A 8/1988 Wesselski
4,824,350 A 4/1989 Sommer et al.
4,949,516 A 8/1990 Long, Jr.
5,125,206 A * 6/1992 Motohashi ..... B64G 9/00 52/646
5,458,647 A 10/1995 Brochier et al.
5,711,131 A 1/1998 Thomas
5,782,693 A * 7/1998 Jordan ..... A63D 15/086 473/48
6,026,626 A 2/2000 Fisher
6,079,178 A 6/2000 Fisher
6,082,068 A 7/2000 Fisher
6,086,481 A 7/2000 Li
6,554,524 B1 * 4/2003 Smith ..... H02G 7/04 403/78
6,615,562 B2 9/2003 Fritsche et al.
6,675,546 B2 * 1/2004 Coles ..... F16B 7/185 403/157
7,024,834 B2 4/2006 Gimpel et al.
7,156,245 B2 1/2007 Lissandre
7,197,856 B2 * 4/2007 Coles ..... E04C 3/005 52/638
7,225,588 B2 6/2007 Nakamura et al.
7,469,514 B2 12/2008 Luo
7,537,417 B2 5/2009 Meyer
8,028,488 B2 10/2011 Dodd
8,099,913 B1 1/2012 Dodd
8,215,326 B2 7/2012 Park et al.
8,627,632 B2 1/2014 Werner et al.
8,628,049 B2 * 1/2014 Ghatikar ..... E04L 39/18 248/201
8,641,312 B2 * 2/2014 Todd, IV ..... E04H 3/28 403/165
8,739,492 B2 6/2014 Hawkins
8,850,774 B2 10/2014 Kempf et al.
8,863,448 B2 10/2014 Werner et al.
8,887,470 B2 11/2014 Werner et al.
8,887,471 B2 11/2014 Werner
8,978,338 B2 3/2015 Jobin et al.
9,140,282 B2 9/2015 Werner et al.
9,650,779 B2 * 5/2017 Tello ..... E04B 1/2403
9,863,138 B2 * 1/2018 Tello ..... E04B 1/2403
2013/0027796 A1 1/2013 Werner et al.
2013/0167891 A1 7/2013 Park et al.
2015/0027970 A1 1/2015 Werner et al.
2015/0062728 A1 3/2015 Werner et al.
2015/0069203 A1 3/2015 Werner et al.
2015/0308117 A1 10/2015 Duschinsky et al.
2015/0330457 A1 11/2015 Koiso et al.
2016/0010897 A1 1/2016 Werner et al.
2017/0056699 A1 3/2017 Todokoro
2018/0030731 A1 * 2/2018 Lafontaine Berger .... E04C 3/08

* cited by examiner

ROTATABLE CONNECTOR FOR TRUSSES

PRIORITY CLAIM

This application claims priority under 35 U.S.C. § 119(e) to U.S. Provisional Application Ser. No. 62/554,346, filed Sep. 5, 2017, which is expressly incorporated by reference herein.

FIELD OF THE DISCLOSURE

The present disclosure relates to trusses, and particularly to trusses having connectors for forming a string of trusses. More particularly, the present disclosure relates to trusses having rotatable connectors for attaching trusses together in a string with the trusses positioned at various angles to one another.

BACKGROUND

Lights and other equipment used for events, such as concerts, plays, or other gatherings, may be held on trusses. The trusses may be transported to an event location and secured together to form scaffolding for positioning the equipment relative to a stage, for example. The size and weight of the equipment attached to these trusses presents design challenges to their positioning and operation.

SUMMARY

A truss in accordance with the present disclosure includes a frame and a rotatable connector coupled to the frame. The frame includes a plurality of chords spaced apart and parallel to one another and a plurality of cross members extending between the chords to couple the chords together. The rotatable connector can attach with a connector of another truss to hold the trusses together in a string. At least a portion of the rotatable connector can rotate relative to the frame and allow trusses to be connected together at a variety of angles relative to one another.

In illustrative embodiments, the rotatable connector includes a sleeve, a rod, and a connector end. The sleeve engages with the truss in a fixed orientation. The rod extends at least partially through the sleeve and engages with the connector end. The rod engages with the sleeve to block removal of the connector end from the sleeve. The rod and the connector end can rotate together relative to the sleeve.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
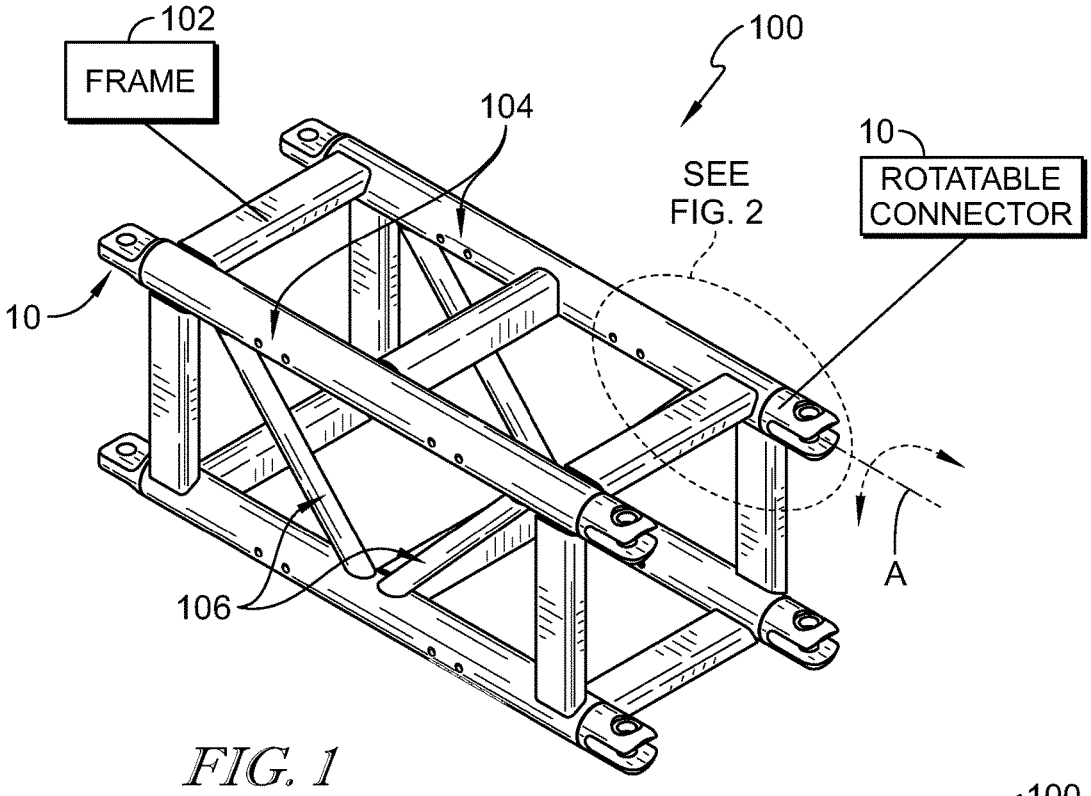
FIG. 1 is a perspective view of a truss in accordance with the present disclosure showing that the truss includes having a frame and a plurality of rotatable connectors attached to the frame for rotation relative to the frame.

A truss 100 in accordance with the present disclosure is shown in FIG. 1. Truss 100 includes a frame 102 and a plurality of rotatable connectors 10 attached thereto. Frame 102 includes a plurality of chords 104 and cross members 106. Chords 104 are spaced apart and parallel to one another. Cross members 106 extend between chords 104 to couple chords 104 together. Frame 102 can be formed in various dimensions with varying numbers of chords 104 and cross members 106 and is not limited to the specific configuration shown in shown in FIG. 1. Rotatable connectors 10 are at least partially received in chords 104 and configured to rotate relative to frame 102 as suggested in FIGS. 2 and 3.

Figure 2:
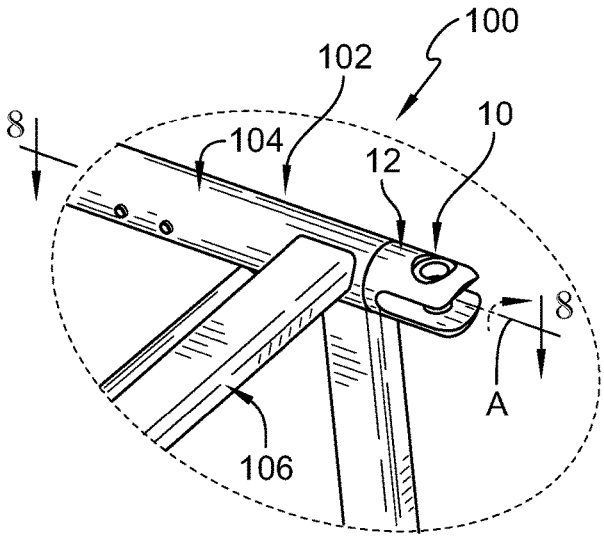
FIG. 2 is an enlarged view of the truss of FIG. 1 showing the rotatable connector in a first position and suggesting that a connector end of the rotatable connector is configured to rotate relative to the frame about an axis (A) to a second position, as shown in FIG. 3, without removal of the rotatable connector from the frame.
Figure 3:
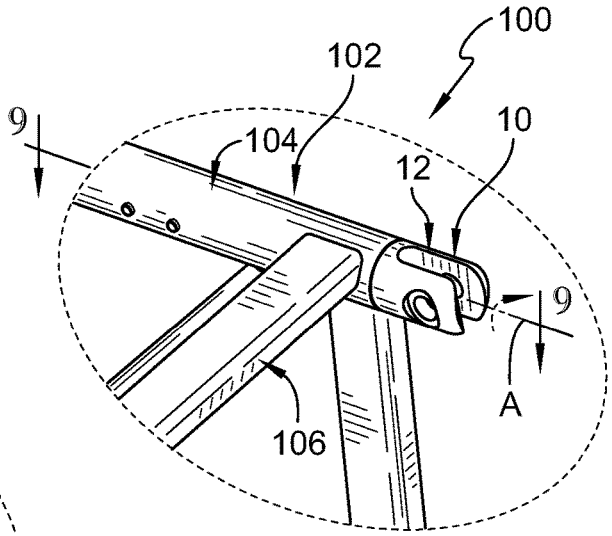
FIG. 3 is a view similar to FIG. 2 showing the rotatable connector moved to the second position.

One rotatable connector 10 is shown in a first position relative to frame 102 in FIG. 2. A connector end 12 of rotatable connector 10 is movable to at least a second position, shown in FIG. 3, without removal of rotatable connector 10 from frame 102. In some embodiments, connector end 12 is configured to rotate 360 degrees relative to frame 102.

Figure 4:
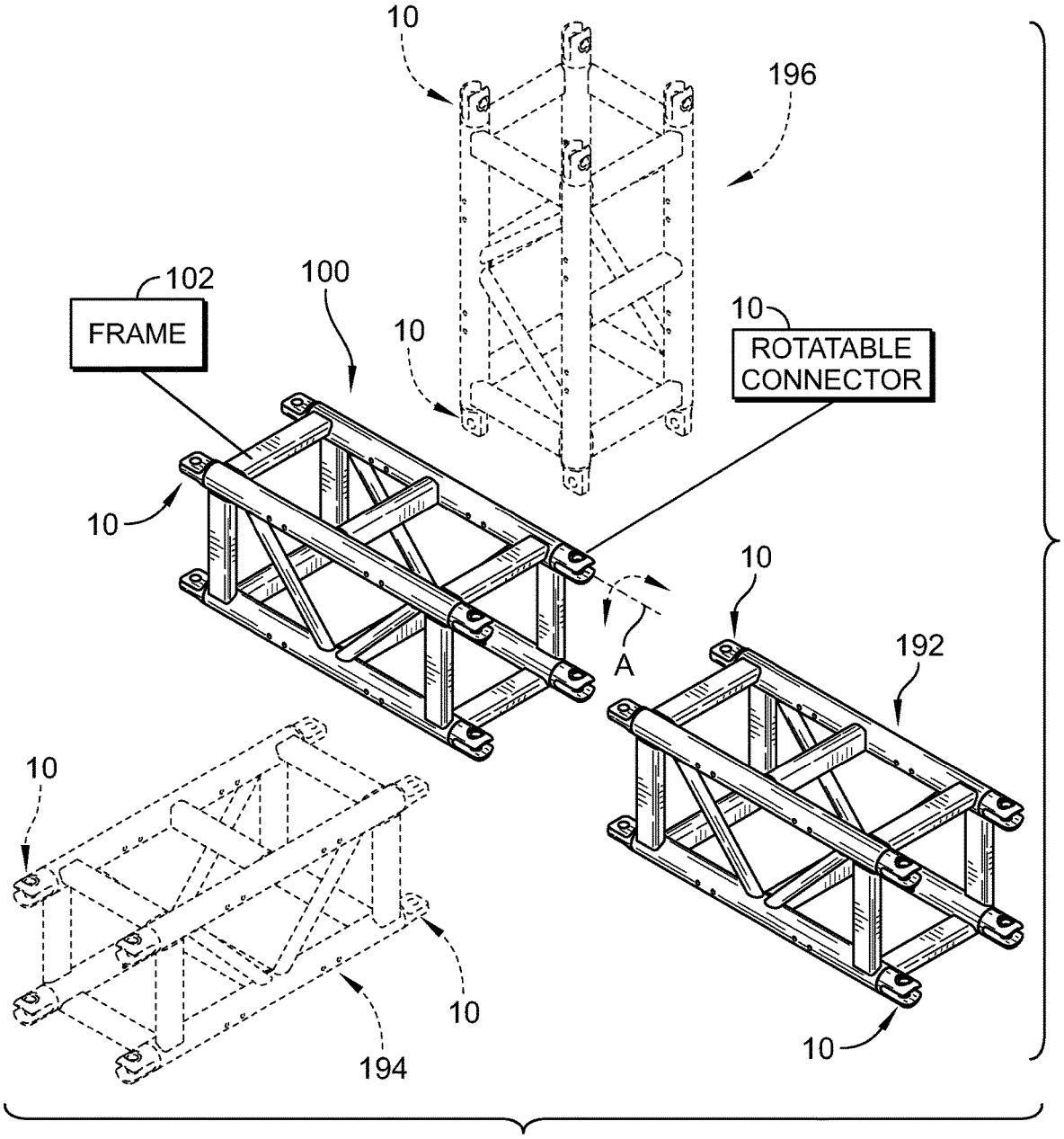
FIG. 4 is a perspective view the truss of FIG. 1 showing a second truss positioned to engage with the first truss to form a string of trusses and suggesting that the rotatable connectors can be rotated to allow attachment of the second truss to the first truss at multiple different angles.

Rotatable connector 10 allows truss 100 to attach with another truss 192 to form a string of trusses as suggested in FIG. 4. Truss 192 is generally aligned with truss 100 and rotatable connectors 10 are at a similar rotational position to allow rotatable connectors 10 to engage with one another. Alternatively or in addition to truss 192, a truss 194 (shown in phantom) can attach with truss 100 at a first angle relative to truss 100. Rotatable connectors 10 of truss 100 are in the first position to attach with rotatable connectors 10 of truss 194. Alternatively or in addition to trusses 192, 194, a truss 196 (shown in phantom) can attach with truss 100 at a second angle relative to truss 100. Rotatable connectors 10 of truss 100 can be rotated to the second position to attach with rotatable connectors 10 of truss 196. Rotatable connectors 10 allow technicians to assemble a string of trusses together at various angles by simply positioning rotatable connectors 10 at a desired angle without having to detach and reattach rotatable connectors 10.

Figure 5:
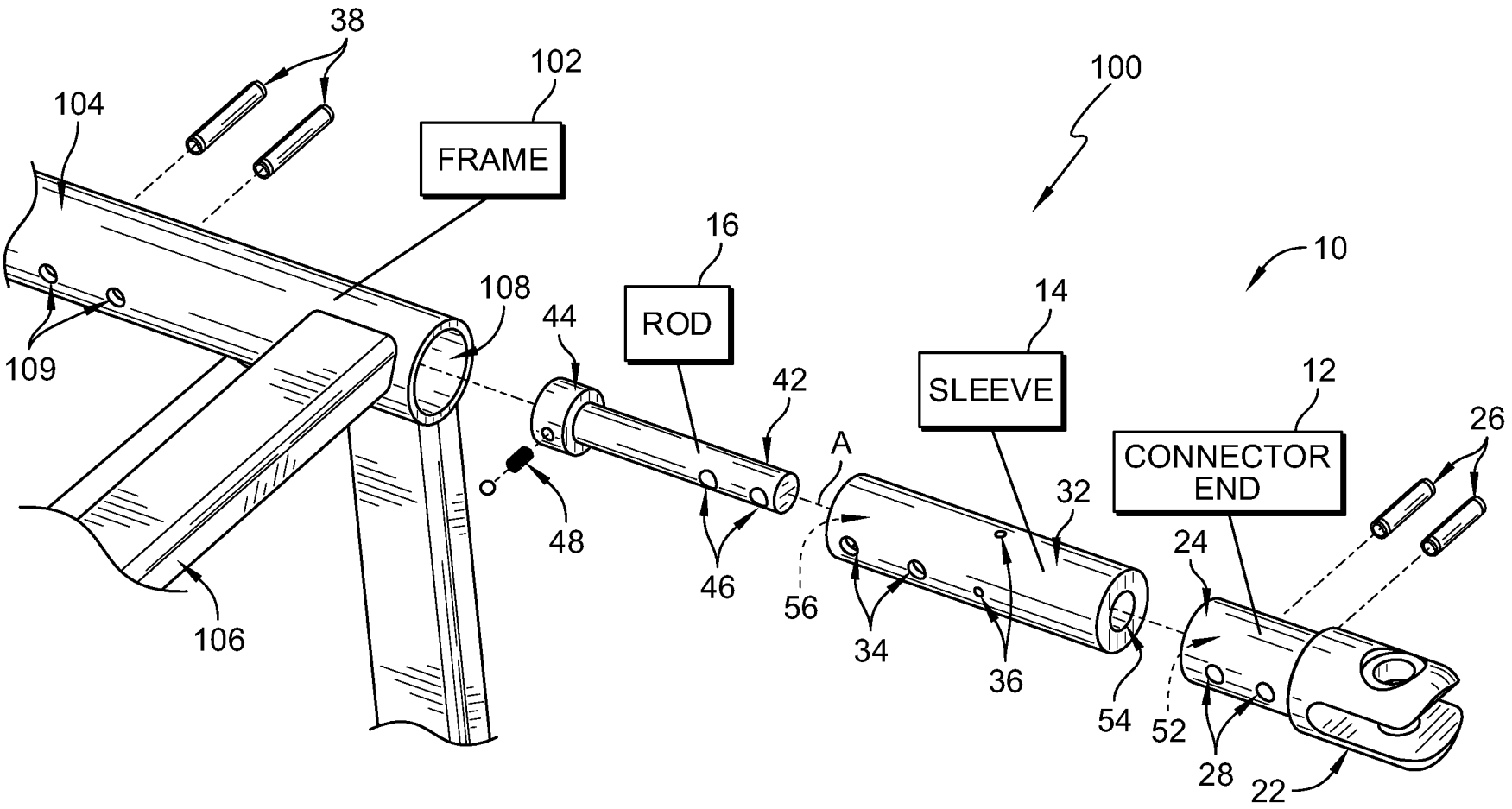
FIG. 5 is an exploded assembly view of the rotatable connector of FIG. 2 showing that the rotatable connector includes a sleeve received in the frame and fixed thereto, a connector end, and a rod extending through the sleeve to engage with the connector end to hold the connector end on the sleeve and suggesting that the connector end and rod rotate together relative to the sleeve and chord.
Figures 6, 7:
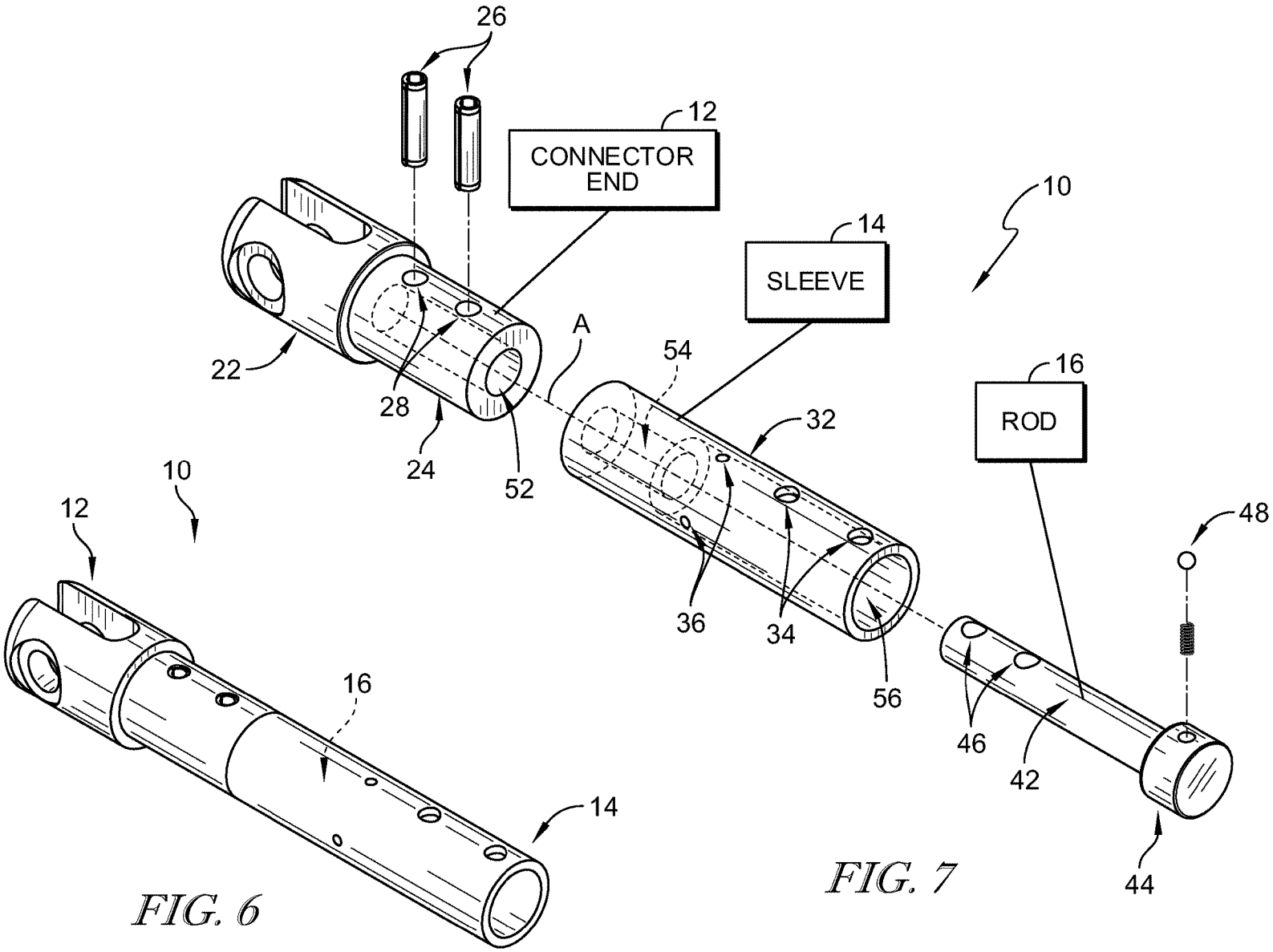
FIG. 6 is a rear perspective view of the rotatable connector of FIG. 5 showing the rotatable connector assembled together prior to insertion into the chord of the frame.
FIG. 7 is an exploded assembly view of the rotatable connector of FIG. 6.

In one illustrative embodiment, rotatable connectors 10 in accordance with the present disclosure each include a connector end 12, a sleeve 14, and a rod 16 as shown in FIG. 5. Sleeve 14 is at least partially received in an interior space 106 of chord 104 and fixed thereto. Rod 16 extends at least partially through sleeve 14 along axis A to engage with connector end 12 to hold connector end 12 on sleeve 14. Connector end 12 and rod 16 rotate together relative to sleeve 14 and chord 104. Rod 16 allows rotation of connector end 12 while blocking removal of connector end 12 from sleeve 14 and chord 104.

Connector end 12 includes a coupler 22 and a base 24 extending from coupler 22 as shown in FIG. 5. In the illustrative embodiment, coupler 22 is a fork configured to engage with an eye (shown for example in FIGS. 1 and 4) that fits into the fork and connects with the fork by a pin to secure truss 100 to another truss 192, 194, 196. The terms fork and eye are used interchangeably herein, and both referred to as a coupler 22, as rotatable connectors 10 can include a fork or an eye so that rotatable connectors 10 can attach with one another. It is to be understood that coupler 22 is not limited to forks or eyes, and can include other shapes as part of another mechanism for connecting rotatable connectors 10 together without departing from the present disclosure.

Sleeve 14 includes a body 32 and holes 34 extending through body 32 as shown in FIG. 5. Rod 16 includes a shank 42 and a head 44 coupled to shank 42. Holes 46 extend through shank 42. In the illustrative embodiment, a detent mechanism 48 (such as a ball bearing and spring) are received in head 48 and engage with set-point holes 36 of sleeve 14 to maintain a rotational position of rod 16 relative to sleeve 14 at the selection of a technician. Four set-point holes 36 are positioned at 90 degree intervals around sleeve 14 as suggested in FIG. 5, but more or less set-point holes 36 can be used and set closer or farther apart from one another. In some embodiments, a pin, fastener, or other positive locking feature is used to set a position of connector end 12 relative to sleeve 14, chord 104, or both.

A recess 52 is formed into base 24 of connector end 12 as suggested in FIG. 5. A minor bore 54 and a major bore 56 are formed into opposing ends of sleeve 14 and connect together to form a contiguous channel through sleeve 14. In some embodiments, minor bore 54 and major bore 56 each extend half way into sleeve 14, but each can extend more or less into sleeve 14. A shoulder 58 is defined at a transition between major bore 56 and minor bore 54 within sleeve 14. In the illustrative embodiment, minor bore 54 is the same or slightly larger in diameter relative to a diameter of shank 42 of rod 16, and major bore 56 is the same or slightly larger in diameter relative to a diameter of head 44.

Rod 16 extends at least partially through sleeve 14 along axis A to engage with connector end 12 as suggested in FIGS. 5-9. Head 44 of rod 16 is received in major bore 56 of sleeve 14 and engages with shoulder 58 to hold rod 16 from axially passing through sleeve 14. Shank 42 of rod 16 is received at least partially through minor bore 54 of sleeve 14 and extends out from sleeve 14 to engage with recess 52 of connector end 12. Pins 26 extend through holes 28 of connector end 12 and holes 46 of rod 16 to attach connector end 12 to rod 16. In the illustrative embodiments, shank 42 is sized to hold connector end 12 in engagement or close to sleeve 14 when rotatable connector 10 is assembled. In some embodiments, connector end 12 is spaced apart from sleeve 14 when rotatable connector 10 is assembled. In some embodiments, connector end 12 is axially movable relative to sleeve 14 and rod 16 engages with sleeve 14 and connector end 12 to hold connector end 12 on sleeve 14. In some embodiments, connector end 12 is retained on rod 16 by a pin, clip, fastener, or other device that allows axial and/or rotatable movement of connector end 12 relative to rod 16 while blocking removal of connector end 12 from rod 16 at the selection of a technician.

Figure 8:
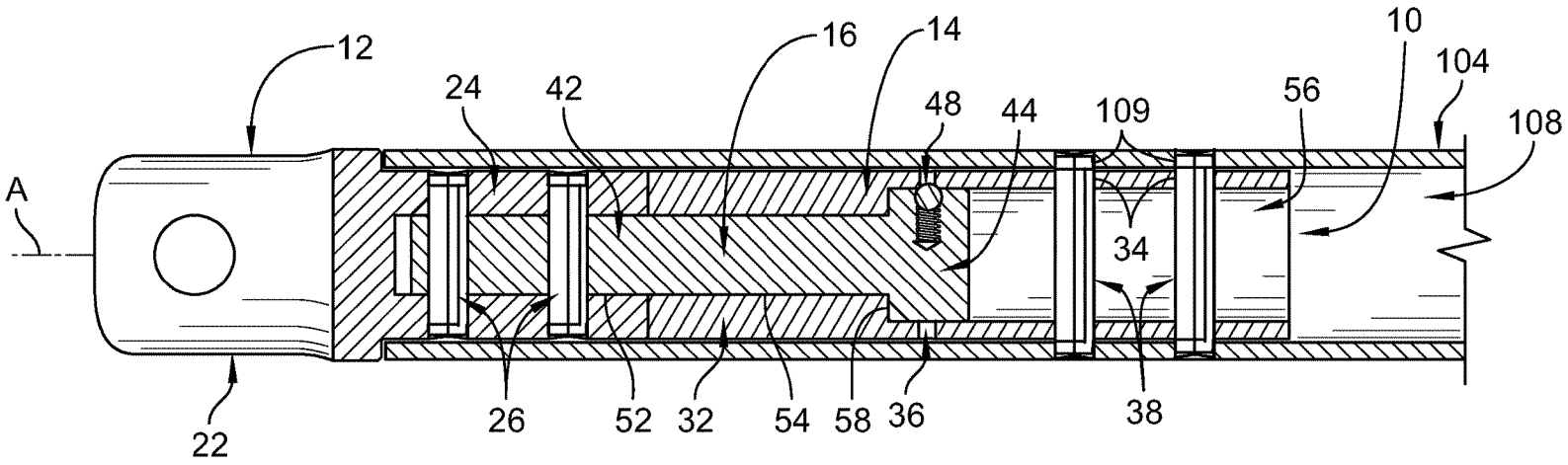
FIG. 8 is a sectional view taken along line 8-8 in FIG. 2.
Figure 9:
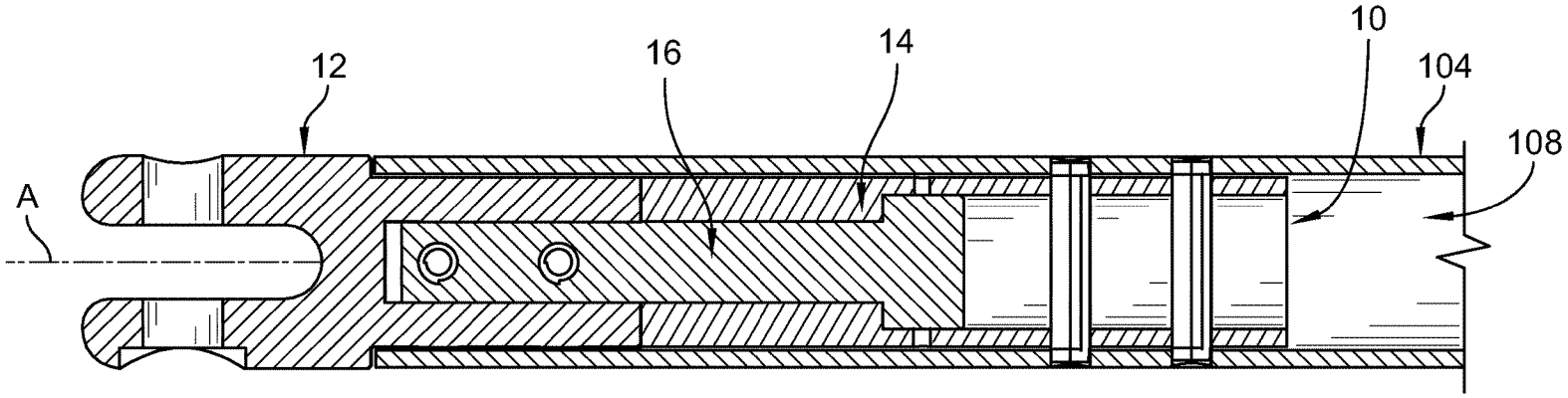
FIG. 9 is a sectional view taken along line 9-9 in FIG. 3.

Rotatable connector 10 is at least partially received in interior space 106 of chord 104 as suggested in FIGS. 8 and 9. Pins 38 extend through holes 108 of chord 104 and holes 34 of sleeve 14 to attach rotatable connector 10 to chord 104. Sleeve 14 is rotatably fixed relative to chord 104 while connector end 12 and rod 16 can rotate relative to chord 104 about axis A. In some embodiments, sleeve 14 is retained on frame 102 by a pin, clip, fastener, or other device that allows axial and/or rotatable movement of sleeve 14 relative to chord 104 while blocking removal of rotatable connector 10 from chord 104 at the selection of a technician.

In the illustrative embodiment, sleeve 14 is completely received in chord 104 as shown in FIGS. 8 and 9. Base 24 of connector end 12 is also received in chord 104. In some embodiments, sleeve 14 extends partially out of chord 104 when mounted on frame 102. In some embodiments, base 24 of connector end 12 is spaced apart from or only partially received in chord 104.

Rotatable connectors 10 in accordance with the present disclosure are simple to manufacture and assemble. Rotatable connector 10 can be disassembled such that any of connector end 12, sleeve 14, or rod 16 can be replaced without needing to replace the whole rotatable connector 10. Rotatable connectors 10 can have interchangeable couplers 22 to allow a technician to reconfigure attachment of trusses together.

Rotatable connectors 10 in accordance with the present disclosure can be used to attach a variety of different components together, such as trusses, poles, ladders, rigging, equipment, and other components and devices. Rotatable connectors 10 are useful in positioning components together for forming a variety of different structures, such as towers, scaffolding, walkways, and others, in a variety of different configurations, positions, and orientations.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A truss comprising:

a frame including a plurality of chords spaced apart from one another and a plurality of cross members extending between the chords to couple the chords together; and a rotatable connector comprising:

a unitary and integral sleeve adapted to be at least partially received in one of the chords;

a rod including a head and a shank extending from the head, the head received in the sleeve and the shank extending at least partially through the sleeve; and a connector end formed separate from the rod and coupled to the shank of the rod in a fixed orientation relative to the rod, wherein the sleeve is configured to engage with the truss in a fixed orientation relative to the truss, the head of the rod is configured to engage with the sleeve to block removal of the connector end from the sleeve while allowing the connector end to rotate relative to the frame about an axis extending through the connector end, the rod, and the sleeve.

2. The truss of claim 1, wherein the connector end is rotatably fixed relative to the rod.

3. The truss of claim 2, wherein the rod and the connector end are configured to rotate together relative to the frame.

4. The truss of claim 2, wherein the connector end is axially fixed relative to the rod.

5. The truss of claim 1, wherein a minor bore and a major bore are formed into opposing ends of the sleeve, wherein the major and minor bores connect together to form a contiguous channel through the sleeve, and wherein a shoulder is formed in the sleeve at a transition between the major and minor bores.

6. The truss of claim 5, wherein the head is sized to be received in the major bore of the sleeve and engage with the shoulder to block the rod from passing completely through the sleeve, and wherein the shank is sized to at least partially pass through the minor bore to engage with the connector end.

7. The truss of claim 6, wherein the connector end includes a coupler and a base extending from the coupler, wherein the base is formed to include a recess, and wherein the shank of the rod extends into the recess to hold the connector end on the rod.

8. The truss of claim 1, wherein the sleeve is axially fixed relative to the frame.

9. The truss of claim 8, wherein the sleeve is rotatably fixed relative to the frame.

10. The truss of claim 1, wherein the chords of the frame are parallel to one another.

11. The truss of claim 1, wherein the sleeve is formed to include one or more set-point holes arranged circumferentially around the axis, and wherein the rotatable connector further includes a detent mechanism coupled to the rod and configured to engage with the one or more set-point holes to hold a rotational position of the connector end at the selection of a user.

12. A rotatable connector for use in a truss, the rotatable connector comprising:

a unitary and integral sleeve configured to engage with the truss in a fixed orientation relative to the truss;

a rod extending at least partially through the sleeve; and a connector end formed separate from the rod and coupled to the rod in a fixed orientation relative to the rod, wherein the rod is configured to engage with the sleeve to block removal of the connector end from the sleeve while allowing the connector end to rotate relative to the sleeve about an axis extending through the connector end, the rod, and the sleeve, wherein the sleeve is formed to include one or more set-point holes arranged circumferentially around the axis, and wherein the rotatable connector further includes a detent mechanism coupled to the rod and configured to engage with the one or more set-point holes to hold a rotational position of the connector end at the selection of a user.

13. The rotatable connector of claim 12, wherein the connector end is rotatably fixed relative to the rod.

14. The rotatable connector of claim 13, wherein the rod and the connector end are configured to rotate together relative to the sleeve.

15. The rotatable connector of claim 13, wherein the connector end is axially fixed relative to the rod.

16. The rotatable connector of claim 12, wherein a minor bore and a major bore are formed into opposing ends of the sleeve, wherein the major and minor bores connect together to form a contiguous channel through the sleeve, and wherein a shoulder is formed in the sleeve at a transition between the major and minor bores.

17. The rotatable connector of claim 16, wherein the rod includes a head and a shank coupled to the head, wherein the head is sized to be received in the major bore of the sleeve and engage with the shoulder to block the rod from passing completely through the sleeve, and wherein the shank is sized to at least partially pass through the minor bore to engage with the connector end.

18. The rotatable connector of claim 17, wherein the connector end includes a coupler and a base extending from the coupler, wherein the base is formed to include a recess, and wherein the shank of the rod extends into the recess to hold the connector end on the rod.

19. A rotatable connector for use in a truss, the rotatable connector comprising:

a unitary and integral sleeve having a minor bore and a major bore formed into opposing ends of the sleeve, the major and minor bores connecting together to form a contiguous channel through the sleeve, and a shoulder formed in the sleeve at a transition between the major and minor bores, the sleeve being configured to engage with the truss in a fixed orientation relative to the truss;

a rod having a head and a shank coupled to the head, the head sized to be received in the major bore of the sleeve and to engage with the shoulder to block the rod from passing completely through the sleeve, and the shank sized to at least partially pass through the minor bore; and a connector end formed separate from the rod, the connector end having a coupler and a base extending from the coupler, the base formed to include a recess, the shank of the rod extending into the recess, and a fastener engaging with the base and the shank to hold the connector end on the rod, wherein the head of the rod is configured to engage with the sleeve to block removal of the connector end from the sleeve while allowing the rod and the connector end to rotate together relative to the sleeve about an axis extending through the connector end, the rod, and the sleeve, wherein the sleeve is formed to include one or more set-point holes arranged circumferentially around the axis, and wherein the rotatable connector further includes a detent mechanism coupled to the rod and configured to engage with the one or more set-point holes to hold a rotational position of the connector end at the selection of a user.

20. The rotatable connector of claim 19, wherein the connector end is axially fixed relative to the rod.

* * * * *